US012593898B1

(12) United States Patent
Kajita et al.

(10) Patent No.: US 12,593,898 B1
(45) Date of Patent: Apr. 7, 2026

(54) SEPERABLE SLIDE FASTENER ACTUATING DEVICE

(71) Applicants: Marcos Suguru Kajita, Arlington, TX (US); Anh Ta Kajita, Arlington, TX (US)

(72) Inventors: Marcos Suguru Kajita, Arlington, TX (US); Anh Ta Kajita, Arlington, TX (US)

( * ) Notice: Subject to any disclaimer, the term of this patent is extended or adjusted under 35 U.S.C. 154(b) by 0 days.

(21) Appl. No.: 18/894,873

(22) Filed: Sep. 24, 2024

Related U.S. Application Data

(63) Continuation of application No. 18/657,579, filed on May 7, 2024.

(51) Int. Cl.
*A44B 19/26* (2006.01)

(52) U.S. Cl.
CPC ..... *A44B 19/262* (2013.01)

(58) Field of Classification Search
CPC ..... A44B 19/262; A47G 25/902
See application file for complete search history.

(56) References Cited

U.S. PATENT DOCUMENTS 2,974,991 A * 3/1961 Gerrick ..... A47G 25/902 294/3.6
3,006,051 A * 10/1961 Maeder ..... A47G 25/902 294/3.6
3,249,977 A * 5/1966 Cloud, Sr. ..... A47G 25/902 294/3.6
3,276,087 A * 10/1966 Hanson ..... A47G 25/902 294/3.6
3,355,779 A * 12/1967 Hurst ..... A47G 25/902 294/3.6
3,836,189 A * 9/1974 Borrelli ..... A47G 25/902 294/99.2
4,022,506 A * 5/1977 Cloud, Sr. ..... A47G 25/902 294/3.6
5,741,035 A * 4/1998 Glass ..... B25B 9/00 24/3.11
6,032,996 A * 3/2000 Kogen ..... A47G 25/902 24/40
7,712,643 B2 * 5/2010 Papernik ..... A47G 25/901 223/111
8,910,983 B1 * 12/2014 Neff ..... A47G 25/902 24/429
9,301,632 B2 * 4/2016 Harris ..... A44B 19/262
9,498,076 B1 * 11/2016 Reid ..... A47G 25/902
9,687,049 B2 * 6/2017 Dhubb ..... B25B 7/02
10,016,082 B1 * 7/2018 Merker ..... A47G 25/90
(Continued)

*Primary Examiner* — Jason W San
*Assistant Examiner* — Rowland Do
(74) *Attorney, Agent, or Firm* — Richard Eldredge; Leavitt Eldredge Law Firm

(57) ABSTRACT

A zipper actuating device includes a first handle configured to provide an actuating force to actuate a zipper handle with a first distal end; a second distal end; and an aperture located near the first distal end configured to slide over a zipper pull tab; a second handle configured to provide a counter force to actuate the zipper with a first distal end; and a second distal end. The counter force allows the actuating force to be transferred to a bottom of the zipper handle which moves a zipper apparatus in a parallel direction to the actuating force to a set of zipper threads.

2 Claims, 10 Drawing Sheets

(56) References Cited

U.S. PATENT DOCUMENTS

| | | | | |
|---|---|---|---|---|
| 2012/0169076 | A1* | 7/2012 | Brake | A47G 25/902<br>294/3.6 |
| 2020/0138220 | A1* | 5/2020 | Denton | A44B 19/262 |
| 2022/0296020 | A1* | 9/2022 | Simo-Fossouo | A47G 25/902 |

* cited by examiner

SEPERABLE SLIDE FASTENER ACTUATING DEVICE

BACKGROUND

1. Field of the Invention

The present invention relates generally to zippers, and more specifically, to a quick-release device configured to engage with the zipper for ease of reach and use.

2. Description of Related Art

One of the problems commonly associated with conventional zipper actuators is the limited use. For example, any mechanical device such as a clamp that only holds onto the zipper handle or pull tab to actuate the zipper must have a clamping force greater than the friction force to hold onto the zipper handle. Such mechanical devices that rely on a clamp to hold onto the zipper handle are not very effective because they do not apply the actuating force effectively to counter act the friction force. This is because pulling the zipper handle alone causes the zipper apparatus to move in a non-parallel or kinked way to its threads resulting in even greater friction force. FIG. 1 illustrates the problem with zipper actuating devices that relies on only holding or clamping via a clip or clamp 103 on the zipper handle 112. As the zipper handle 112 is pulled by actuating force 115 created by pulling on a cord 105, the zipper apparatus 111 is forced to move in a non-ideal position causing kinks on the zipper threads. These kinks on the zipper thread 107 results in a much greater friction force 116. That is why devices that simply rely on holding onto the zipper handle 112 do not work effectively. It is often the case that the clamp cannot hold onto the zipper handle making such devices useless.

Although great strides have been made in the area of zipper systems and methods of use, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
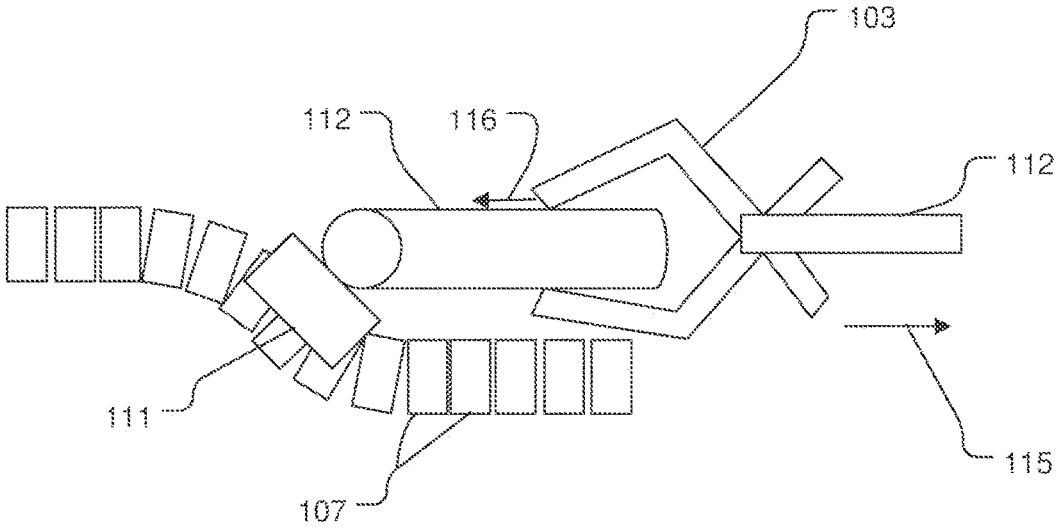
FIG. 1 (Prior Art)
FIG. 1 is simplified schematic of a conventional zipper actuator.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIGS. 1-9 depict various views of a device 1 and method of use in accordance with a preferred embodiment of the present application.

Figure 2:
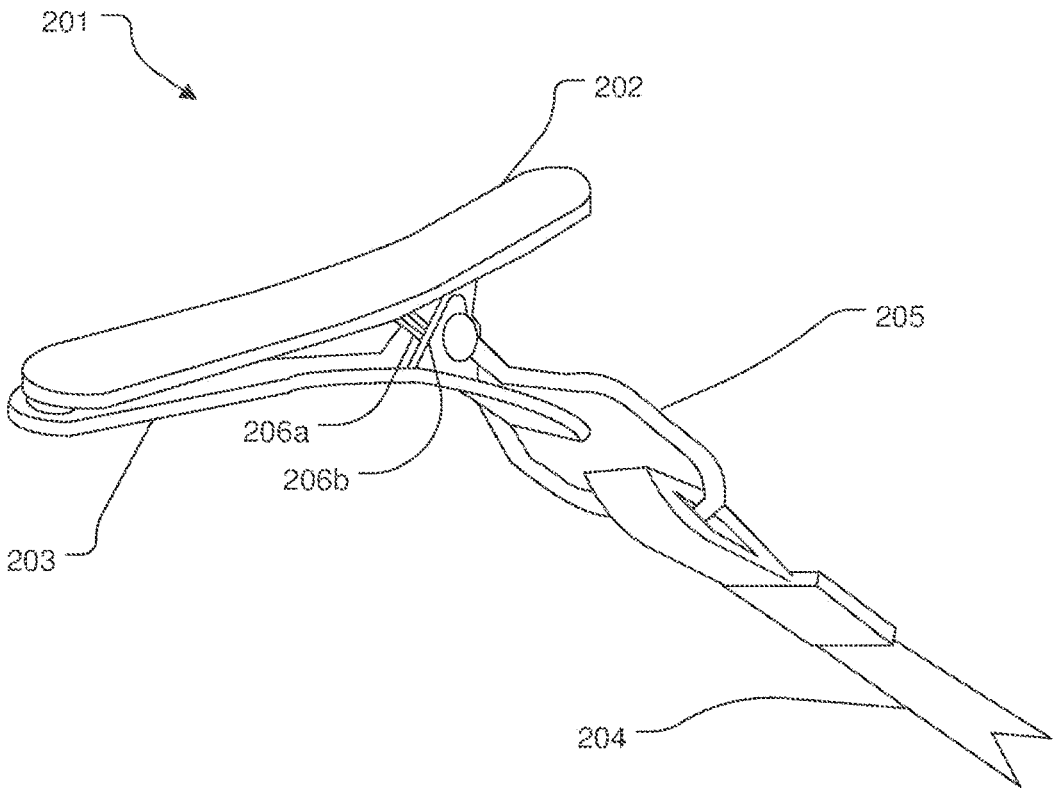
FIG. 2 is a perspective view taken from the side of a separable slide fastener or zipper actuating device constructed in accordance with a preferred embodiment of the present invention.

FIG. 2 is a perspective view taken from the side of a separable slide fastener or zipper actuating device 201 constructed in accordance with the invention. Device 201 is preferably divided into three portions: an upper handle 202, a lower handle 203, and a flexible cord 204.

Flexible cord 204 is connected to the upper handle 202 and lower handle 203 by a ring 205. Ring 205 connects upper handle 202 and lower handle 203 by pin inserted through hinges 206*a* and 206*b*. All parts of device 201, except for flexible cord 204, can be made of metal, hard plastic, or any other hard materials. Flexible cord 204 can be made of lanyard, metal chain, soft plastic, or any flexible materials.

Figure 3:
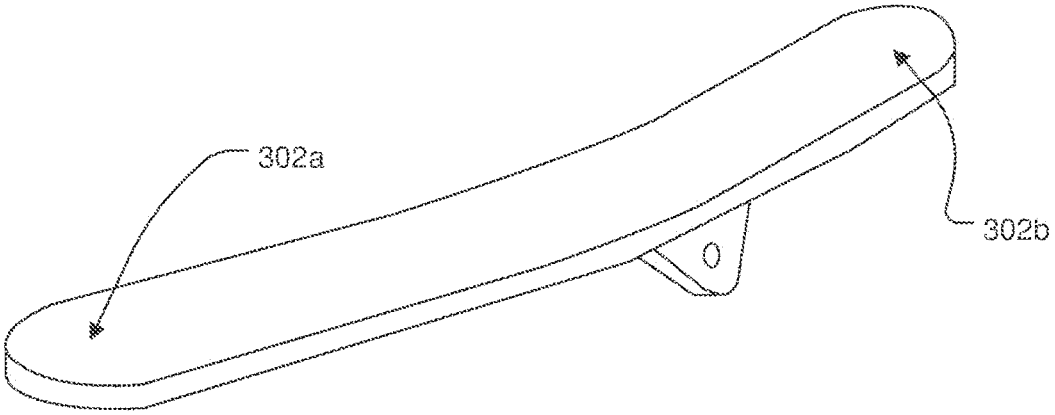
FIG. 3 is the perspective view taken from the top and side of an upper handle of the zipper actuating device of FIG. 1.

FIG. 3 is the perspective view taken from the top and side of upper handle 202 of device 201. Hinge 206*a* located on the lower surface of upper handle 202 attaches to hinge 206*b* on the upper side of lower handle 203 of device 201. The lower surface of tip 302*a* of upper handle 202 touches upper surface of lower handle 203 when device 201 is in clipped (or closed) position.

Figure 4:
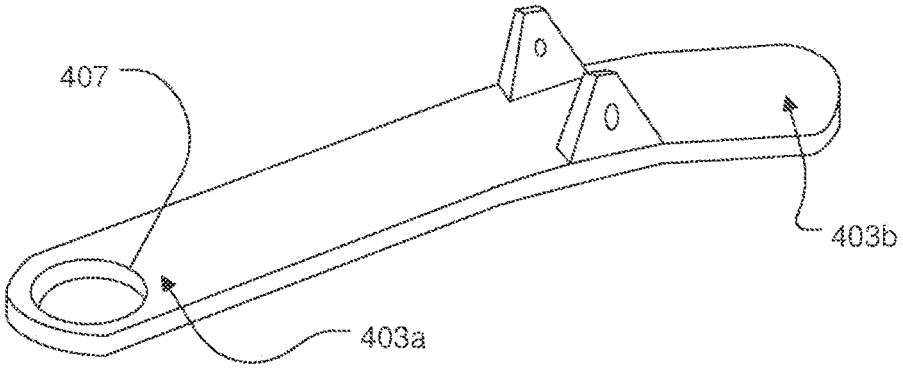
FIG. 4 is the perspective view taken from the top and side of a lower handle of the zipper actuating device of FIG. 1.

FIG. 4 is the perspective view taken from the top and side of lower handle 203 of the device 201. Hinge 206*b* located on the upper surface of lower handle 203 attaches to hinge 206*a*. Orifice or aperture 407 at tip 403*a* is a perforation through lower handle 203.

Figure 5:
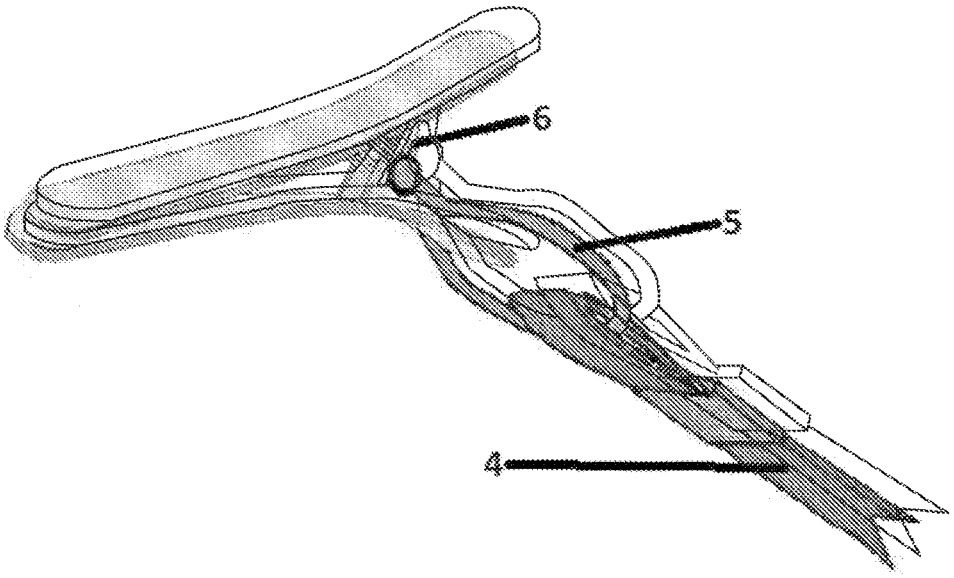
FIG. 5 is an enlarged view of a flexible cord attached to the zipper actuating device of FIG. 1 by a ring.

FIG. 5 is an enlarged view of flexible cord 204 attached to device 201 by ring 205. Ring 205 connects upper handle 202 and lower handle 203 via pin inserted through hinge 206. Ring 205 shown in semi-circular is not limited to a circular shape. Ring 205 can be in any other shape that satisfies the purpose of securing flexible cord 204 to device 1. Ring 205 allows flexible cord 204 to be pulled in an angle most comfortable to the user.

Figure 6:
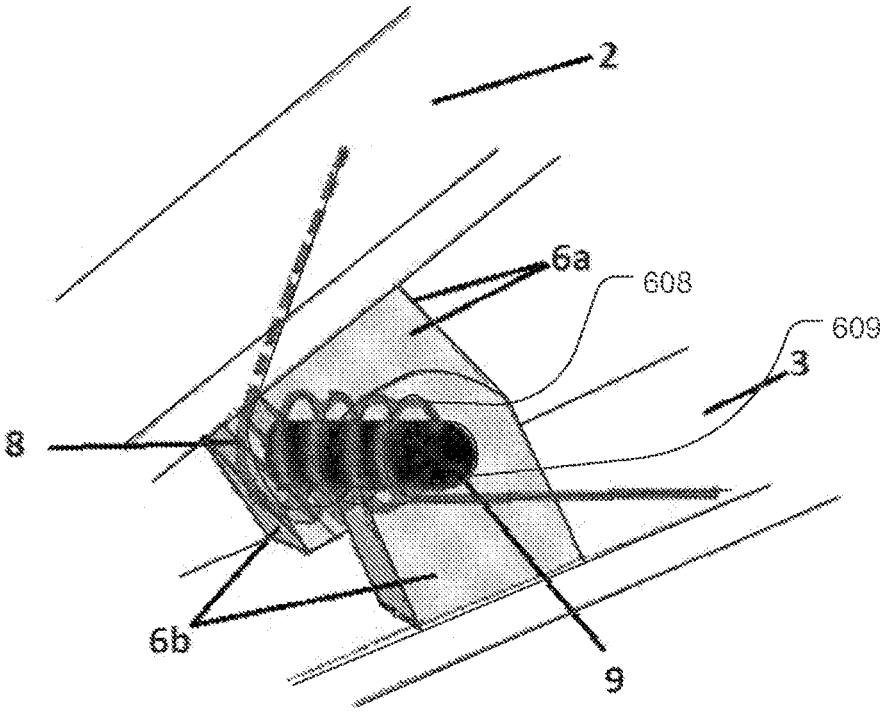
FIG. 6 is a lateral view of a hinge showing the position of a spring the zipper actuating device of FIG. 1.

FIG. 6 is a lateral view of hinge 206 showing the position of spring 608. The opening of spring 608 faces towards the tips 302*b* and 403*b* of device 201. Spring 608 is compressed when both ends 302*b* and 403*b* are pressed towards each other. A connector pin 609 holds both upper and lower handle 202 and 203 of device 201 together through hinge 206. Pin 609 also passes through spring 608 and secures hinge 206. Spring 608 applies force towards the inner sides of both upper and lower handle 202 and 203 of device 201. The force generated by spring 608 allows device 201 to have a strong grip when used to clip over a zipper puller handle.

Figure 7:
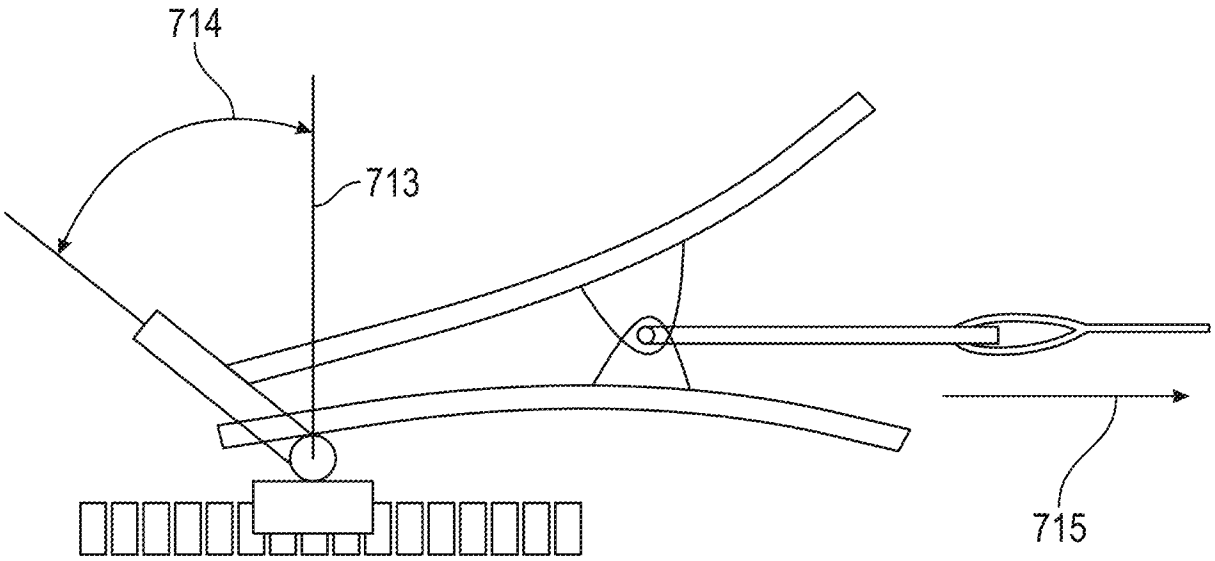
FIG. 7 is the perspective view taken from the side of the zipper actuating device of FIG. 1 clipped onto a zipper puller handle.

FIG. 7 is the perspective view taken from the side of device 201 clipped onto zipper puller handle 112. Zipper puller handle 112 is inserted through orifice 407 of lower handle 203 of device 201. Upper handle 202 clips onto zipper puller 112 holding it at an angle 714 to the imaginary y-axis 713. Imaginary y-axis 713 is perpendicular to the actuating motion vector 715. Motion vector 715 is the direction to which device 201 is being pulled.

In normal operation, if zipper puller handle 112 is pulled without the upper handle 202, the lower handle 203 would slip off zipper puller handle 112. However, having upper handle 202 clipped onto zipper puller handle 112 forming angle 714 prevents the rotation of zipper puller handle 112 allowing device 201 to remain attached, or clipped, to zipper puller handle 112 allowing user to pull cord 204 in the direction of motion vector 715 to actuate zipper to close or open position.

Figure 8:
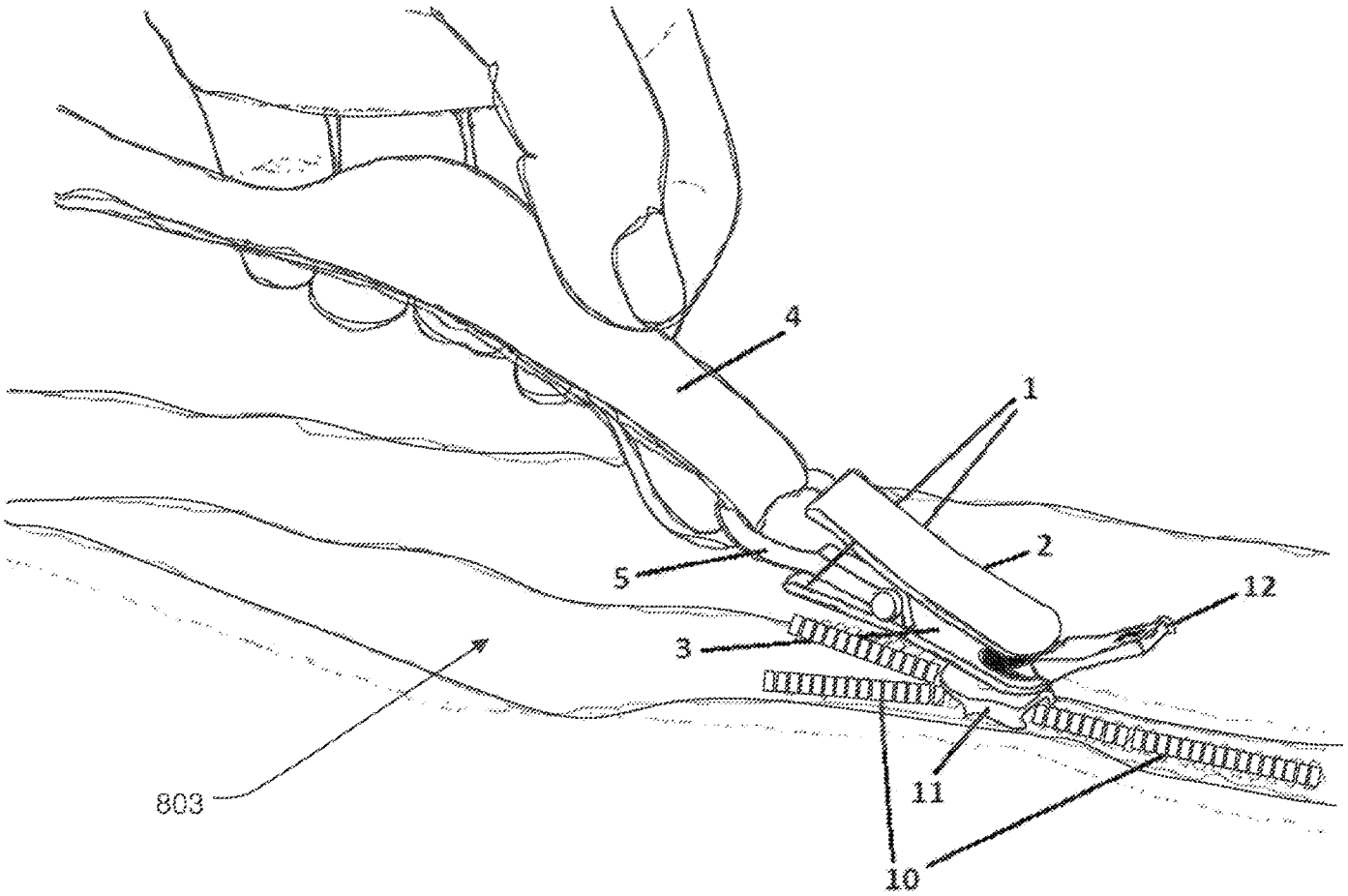
FIG. 8 is the perspective view taken from the top and side of the zipper actuating device of FIG. 1 attached to a zipper puller on a garment.

FIG. 8 is the perspective view taken from the top and side of device 201 attached to zipper puller 112 on a garment 803. Flexible cord 204 is pulled for the purpose of closing the zipper. Device 201 can also be employed for opening zipper on garments. In this case, device 201 needs to be attached or clipped in the opposite direction.

Figure 9:
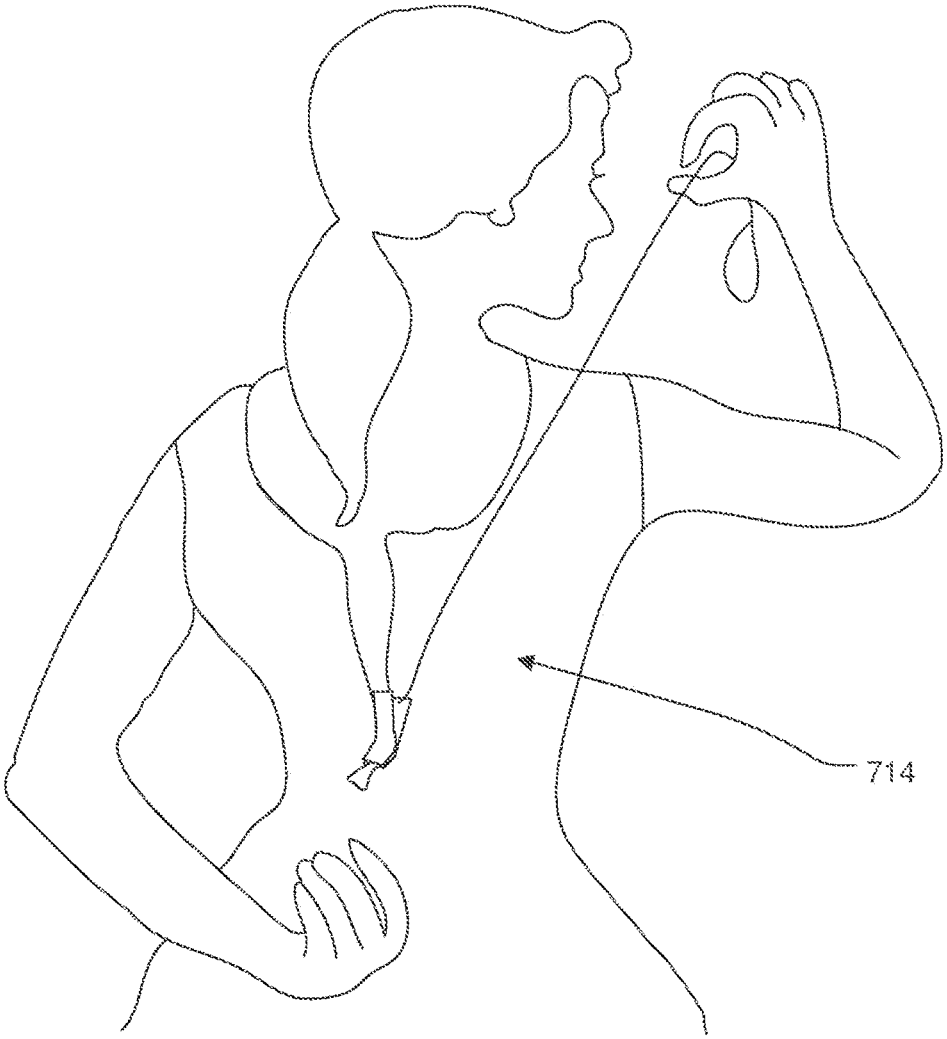
FIG. 9 is the perspective view of user actuating zipper on the back of user's dress using the zipper actuating device of FIG. 1.

FIG. 9 is the perspective view of user actuating zipper on the back of user's dress using device 201. Device 201 can be used to, but it is not limited to, actuate zipper on the back of a dress 903. FIG. 9 shows user using device 201 to close zipper. User uses one hand to hold lower end of zipper while user pulls flexible cord 204 upwards to close zipper. While user pulls device 201, the user can, when desired, hold opposite side of zipper, for more effective operation of device 201.

Most garments are flexible and holding opposite side of zipper allows for smoother slide. As user pulls device 201 upward, the user can, when desired, hold flexible cord 204 at different lengths for more comfortable operation of device 201. Depending on the entire length of zipper, the user will need to pull flexible cord 204 for a length over the user's arm length. In that case, user will need to change the grip with flexible cord 204 to a shorter length allowing for the completion of operation. The user can, when desired, attach device 201 to zipper puller handle 112 before putting garment on. This particular procedure makes the use of device 201 easier. Once user has garment on, device 201 can be used to actuate zipper to closing position as described above. In order to open zipper on garment, the user needs to clip device 201 in the opposite direction to closing zipper. The user holds upper end of zipper and slide device 201 downward to open zipper.

Figure 10:
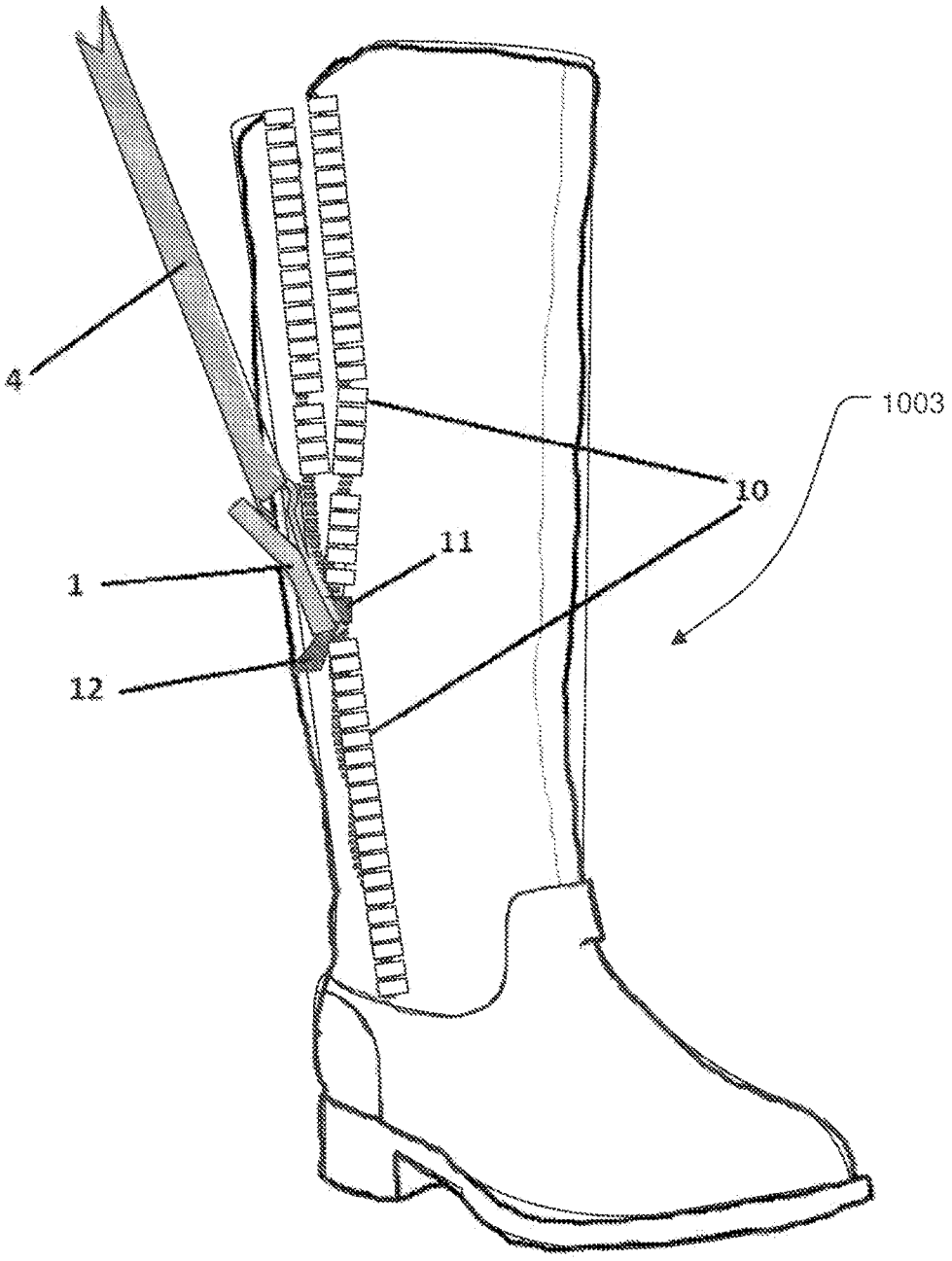
FIG. 10 is the perspective view of the zipper actuating device of FIG. 1 being used to actuate zipper on boots.

FIG. 10 is the perspective view of device 201 being used to actuate zipper on a boot 1003. Device 201 can be used to, but it is not limited to, actuate zipper on long boots.

Figure 11:
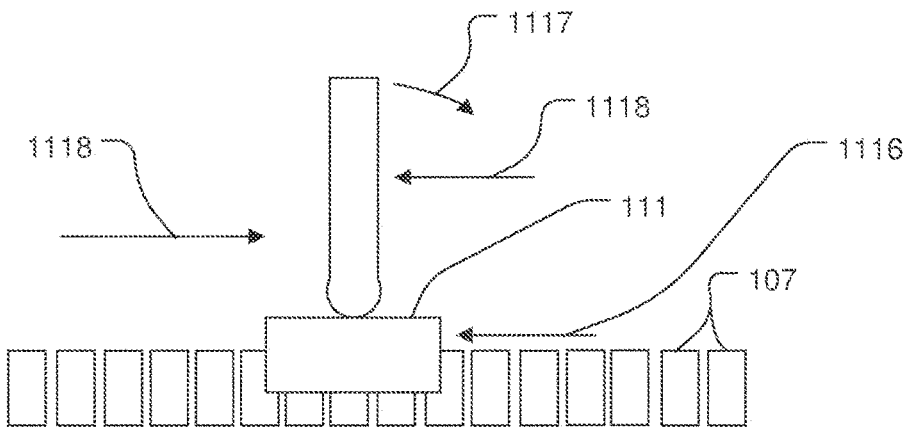
FIGS. 11-12 are front and side views of the forces present when the present invention is in use.
Figure 12:
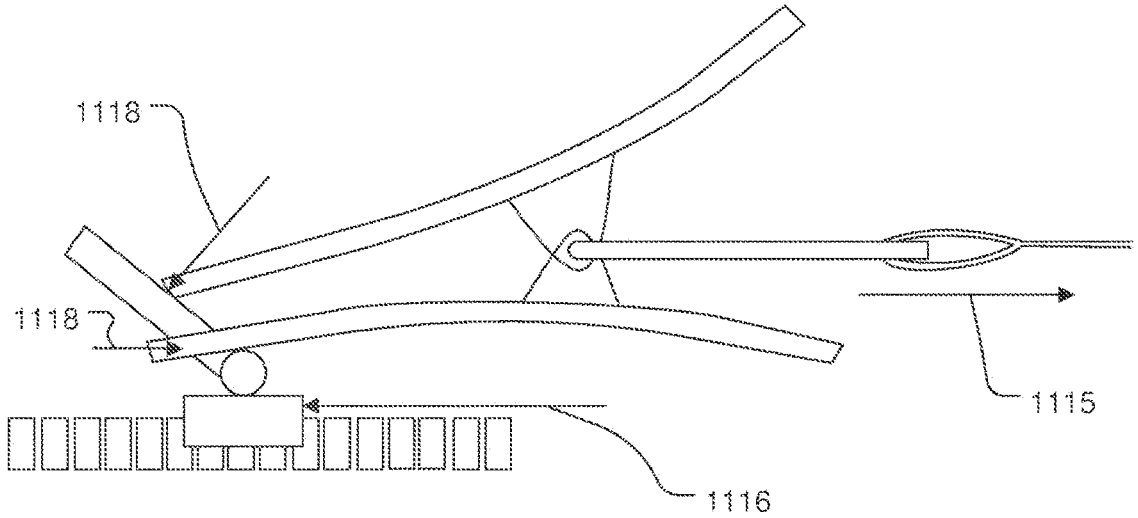

FIG. 11-12 are simplified schematics of the forces present during use of the present invention. The key idea presented by this patent is the use of an apparatus that prevents the radial motion 1117 or rotation of the zipper handle 112 when a force 1115 is applied to the zipper handle 112 in the direction in which the zipper is being actuated. The figure below further illustrates the forces acting on the zipper handle when the motion or force 1115 to actuate the zipper is applied.

When force 1115 which actuates the zipper, is applied to zipper handle 112, the zipper apparatus 111 that holds the zipper threads 107 together produces a friction force 1116 in the opposite direction to the force 1115 actuating the zipper. The friction force 1116 produces a radial motion 1117 of the zipper handle towards the direction of actuating force 1115 The radial motion 1117, if not counter acted, will result in the zipper handle 112 be parallel to actuating force 1115.

The use of the counter force 1118 provides a solution to move the zipper apparatus 1111 in an ideal way. The core idea of counter force 1118 allows the actuating force 1115 to be transferred to the bottom of the zipper handle 112 which moves the zipper apparatus 111 in parallel to actuating force 1115 and in parallel to its threads 107.

It is contemplated that the use of the present invention produces a counter force 1118 to counter act the radial motion 1117, allows the transfer of the actuating force 1115 to the zipper apparatus 111, and provides a smooth actuation of the zipper. There are many contemplated embodiments of the present invention that allow for the design of mechanical devices that provide the point of contact to the zipper handle 112 and a point of contact that produces the counter force 1118 to the radial motion 1117. This patent shall cover all designs that make use of the core idea of counter force 1118.

Figure 13:
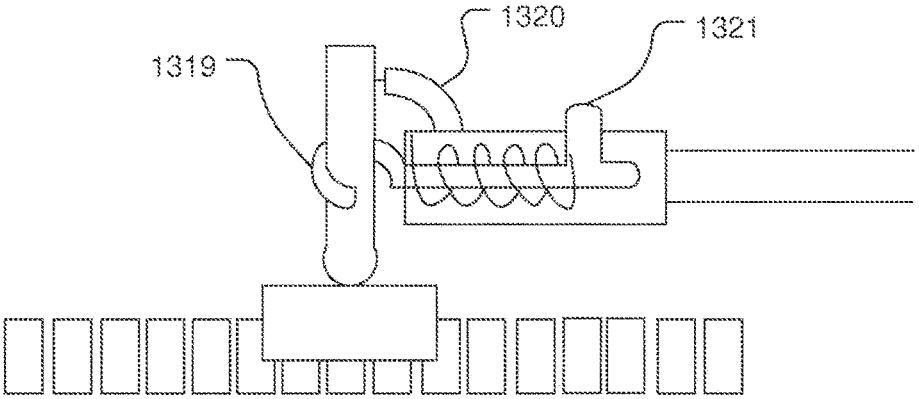
FIG. 13 is a side view of an alternate embodiment of the present invention.

Referring now to FIG. 13, an alternate embodiment of the present invention is shown having a hook 1319 that hooks to the zipper handle 112 to provide the point of contact. The hook is part of an apparatus with a button 1321, a spring, and a casing. The button 1321 allows the hook to move and hook onto the zipper handle 112. The spring provides the tension to hook to the zipper handle. An curved arm 1320 above the hook provides the counter force 1118.

It is anticipated that when an actuating force is applied, the same force is applied to the zipper handle 112 by the hook 1319. A frictional force produces radial motion. The curved arm 1320 contacting the zipper handle 112 produces a counter force in similar fashion as shown in FIG. 11-12.

Figure 14:
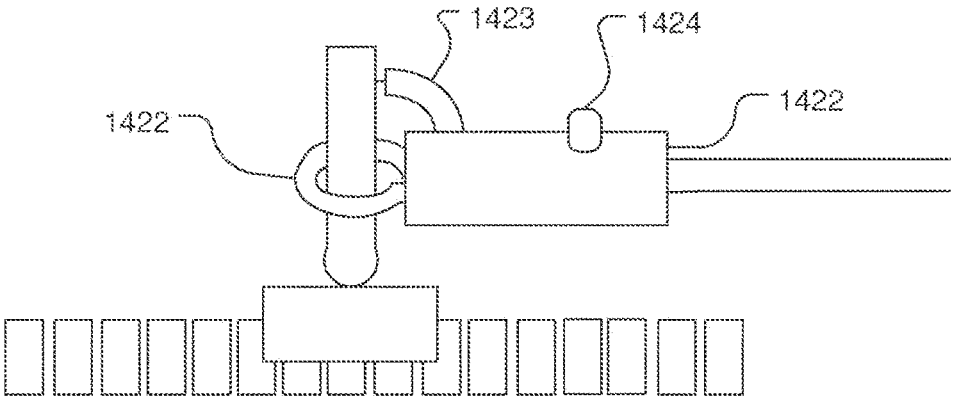
FIG. 14 is a side view of an alternate embodiment of the present invention.

Referring now to FIG. 14, an alternate embodiment of the present invention is shown having a ring or a lasso 1422 that is part of the cord 204. A friction producing clamp 1424 keeps the casing 1425 in place. The casing 1425 has an arm 1423 that contacts the zipper handle and provides the counter force 1118. It is anticipated that when an actuating force is applied, the friction force caused by the zipper produces radial motion. The arm 1423 provides the counter force, which allows the transfer of the actuating force from the point of contact of lasso 1422 on the zipper handle 112 down to the zipper.

In operation, one use of device 201 is to actuate hard to reach separable sliding fasteners or zippers. For example, device 201 can be used to, but it is not limited to, actuate zipper on the back of dresses. Device 201 can also be used to, but it is not limited to, actuate zipper on long boots or scuba diving suits. Any zipper that is hard to reach can be actuated with device 201 to close or open. Device 201 can be used to open or close zippers. The user clips device 201 to zipper puller by pressing both handles 302*b* and 403*b*, inserting zipper puller from the lower side of handle 203 through orifice 407, and releasing handle tips 302*b* and 403*b* thereby clipping the zipper puller handle 112 with upper handle 302*a* tip. Once device 201 is securely clipped to zipper puller handle 112, the user can pull flexible cord 204 to the desired direction either to close or open the zipper. For effective use of device 201, user needs to follow the steps above making sure that the zipper puller is inserted through orifice 407 such that handle tip 302*b* clips onto zipper puller handle 112 the same way it is depicted in FIG. 7.

Device 201 can be used to open or close zippers with any shape or size of zipper pullers as long as the zipper puller handle 112 can be inserted through orifice 407. Device 201 has a great advantage over current zipper actuating devices on the market because of its capability of actuate zippers with zipper puller handles of many shapes or sizes. Many zipper actuating devices on the market relies on the zipper puller having an orifice to hook the actuating device on. Modern zippers have many different kinds and shapes of zipper puller handle 112. Most of modern zipper puller handles do not have an orifice making actuating devices with hooks useless. Other zipper actuating devices only work if the zipper puller handle 112 is of a certain shape or size. Device 201 can actuate zippers with zipper puller handle 112 of many shapes and sizes provided that zipper puller handles 112 can be inserted through orifice 407.

The user can, when desired, clip device 201 to zipper puller handle 112 before putting garment on. This way, the user can easily pull flexible cord 204 to the direction of closing zipper as soon as garment is put on. Once the garment is put on, the user holds lower end of zipper, if zipper closes on upward direction, and pulls flexible cord 2024 to the direction of closing. If user chooses not to clip device 1 prior to wearing the garment, device 201 can be easily clipped to zipper puller handle by following the steps described above.

In order to open zipper, device 201 needs to be attached to zipper puller handle such that when flexible cord 204 is pulled zipper will open. Hence, in order to close zipper, device 201 needs to be attached to zipper puller handle 112 in the opposite direction to open. After completion of either open or close operation, device 201 can be detached from zipper puller handle 112 by simply pressing upon upper and lower handle tips 302*b* and 403*b* releasing zipper puller handle 112.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A zipper actuating device configured to releasably engage with a zipper having a pull tab, the zipper actuating device comprising:

a first handle having:

a first distal end;

a second distal end; and an aperture provided on and through the first distal end, and the aperture is sized to fit the pull tab therethrough;

a second handle configured to provide a stabilizing counter force having:

a first distal end; and a second distal end;

wherein the pull tab is sandwiched between the first handle and the second handle and passes through the aperture while in a locked position;

a flexible cord;

a fastener configured to connect the upper and lower handle to the flexible cord;

wherein the zipper actuating device is configured to allow a user to easily pull the flexible cord in an upward direction to close a zipper;

a hinge configured to connect the first handle to the second handle, the flexible cord is connected to the hinge; and a spring connected to the hinge, the first handle, and the second handle.

2. The zipper actuating device of claim 1, further comprising:

a casing connecting the flexible cord to the first handle;

a spring located inside the casing;

a button located on an outside surface of the casing configured to allow the first handle to move and attach to a zipper pull tab;

wherein the first handle is configured as a hook configured to wrap around a zipper pull tab; and wherein the second handle is configured as curved arm.

* * * * *